US007093307B1

(12) United States Patent
Smith

(10) Patent No.: US 7,093,307 B1
(45) Date of Patent: Aug. 22, 2006

(54) ANTI-STATIC PROTECTIVE GARMENT

(75) Inventor: W. Novis Smith, Philadelphia, PA (US)

(73) Assignee: Lakeland Industries, Ronkonkoma, NY (US)

( * ) Notice: Subject to any disclaimer, the term of this patent is extended or adjusted under 35 U.S.C. 154(b) by 315 days.

(21) Appl. No.: 10/671,401

(22) Filed: Sep. 25, 2003

(51) Int. Cl.
*A41D 13/00* (2006.01)

(52) U.S. Cl. ..... 2/457

(58) Field of Classification Search ..... 2/457, 2/458, 2.11, 2.14, 81, 901, 904; 428/36.1–36.7; 442/255, 261, 1, 20, 327, 41, 50
See application file for complete search history.

(56) References Cited

U.S. PATENT DOCUMENTS

| | | | | | |
|---|---|---|---|---|---|
| 5,002,795 | A | * | 3/1991 | Keough | 427/506 |
| 5,082,721 | A | * | 1/1992 | Smith et al. | 442/289 |
| 5,162,148 | A | * | 11/1992 | Boye et al. | 442/395 |
| 5,223,553 | A | * | 6/1993 | Keough | 522/78 |
| 5,250,350 | A | * | 10/1993 | Tung | 428/216 |
| 5,811,359 | A | * | 9/1998 | Romanowski | 442/261 |

* cited by examiner

*Primary Examiner*—Tejash Patel
(74) *Attorney, Agent, or Firm*—John Lezdey & Assoc

(57) ABSTRACT

Disposable chemical and biological protective garments have an internal film or coating of conductive and water absorbing inorganic salts which are antistatic agents activated by the internal humidity generated by the wearer.

18 Claims, No Drawings

ANTI-STATIC PROTECTIVE GARMENT

FIELD OF THE INVENTION

The present invention relates to disposable protective garments for use against chemical and biological agents, having anti-static capabilities. More particularly, there is provided a protective garment having internal anti-static agents.

BACKGROUND OF THE INVENTION

Static charging of plastics is a problem when used in hospitals because of the presence of explosive gases such as ethers. Therefore, anti-static agents have either been incorporated into the plastic or sprayed on the external surface. In chemical protective garments, tear resistance and abrasion resistance are important so that incorporating the anti-static agents into the plastic is generally not employed because they weaken the plastic. Tear and abrasion resistance is important in military and firefighting protective garments so that a weakening of the plastic film is avoided. External and anti-static agents can be abraded off or inactivated by external chemicals reactions and can be generally less effective because they are not concentrated at the surface of the film or fabric where they are most needed.

It is generally assumed that interfacially active molecules of some anti static agents function by accumulating on the surface and are oriented with the hydrophobic part containing a paraffin chain extending into the plastic and a hydrophilic part pointing outwards where it is able to adsorb water on the surface. In consequence of their interfacially active character, antistatic agents decrease the phase boundary angle between water and plastic, thus allowing water to be uniformly distributed on the surface. A water film, whose thickness depends on the atmospheric humidity, forms on the plastics' surface, thus increasing the conductivity by means of an ion conduction process and dissipating static charge build-up. This also explains why the surface conductivity and hence the antistatic action progressively decrease with decreasing atmospheric humidity.

More recently it has been postulated that charge exchange, in addition to the ion conduction mechanism, is effected through a constant exchange of water between the surface and the environment. This would be in accord with the mechanism of air ionization. In contrast to this, however, the antistatic agent on the surface acts as a contact point for the charge exchange.

In addition, charge transfer can be accomplished by a proton shift. Antistatic agents bearing —$CO_2H$, OH or $NH_2$, —$SO_3H$ groups are able to associate in chain form via hydrogen bonding, and display antistatic activity even at low atmospheric humidity, unlike compounds which are able to form only intramolecular hydrogen bonds.

Many antistatic agents also show hygroscopic properties, thereby intensifying the attraction of water to the surface. At constant atmospheric humidity a hygroscopic compound combines more water at the surface and so increases the antistatic effectiveness.

Application of antistatic agents in the normal concentration range brings about a decrease in the surface resistivity from $10^{14}$–$10^{16}$ to approximately $_{10}{}^{8}$–$10^{10}\Omega$. A further decrease is attainable only by increasing the surface conductivity.

Many antistatic agents in use today are classified as cationic, anionic, nonionic, and amphoteric compounds. The molecules have a hydrophilic part and a hydrophobic component. The hydrophobic part confers a certain compatability with the particular polymer and is responsible for anchoring the molecule on the surface while the hydrophilic part takes care of the binding and exchange of water on the surface.

A number of external agents are applied to the external surface of molded articles from aqueous or alcoholic solutions. Hygroscopic agents such as glycerin, polyols, and polyglycols, quaternary ammonium salts, sodium alkyl sulphonates and fatty acid monoglycerides appear to be the preferred choices for external antistatic activity.

The problem with external antistatic agents is their decreased activity in low humidity areas and under arid conditions. Moreover, external antistatic agents can be washed off, rubbed off, or inactivated by chemical agents.

SUMMARY OF THE INVENTION

The present invention relates to disposable protective garments having a water absorbing and conductive inorganic salt within its interior. Preferably, the water absorbing and conductive salt is placed on the interior side of the outer film or on a non-woven scrim. Accordingly, the protective garment comprises:

a) an outer polymeric film, and optionally, b) a non-woven scrim adhesively attached to the outer film, said scrim having incorporated an antistatic effective amount of a water absorbing or hygroscopic inorganic salt which is activated by the humidity created by the wearer of the suit. Alternatively, the garment does not have a scrim and the antistatic salt is on the interior. Preferably the salt is powdered.

It is understood that when the protective garment does not have an internal scrim, the water absorbing and conductive salt is coated on the interior surface of the polymeric film.

Advantageously, about 10 to 25 mg per $m^2$ are utilized depending upon the water absorbing salt. Preferably, about 0.1 to 10% by weight of the total garment of the water absorbing salt is utilized on the interior surface of the garment or the scrim.

It is understood that the term "water absorbing" and "water absorbing conductive" salts include salts in which water has become part of the molecular structure prior to or during coating of the interior scrim.

DESCRIPTION OF THE PREFERRED EMBODIMENTS

According to the present invention there is provided a disposable protective garment comprising an outer layer of polymeric film in which the interior of the garment has an antistatic effective amount of a conductive water absorbing salt so as to reduce the surface resistivity (Ω) to at least $10^{10}$ to $10^{11}\Omega$ according to DIN 53482.

Depending upon the use of the garment and the area where the garment is used, a scrim is utilized that contains the anti static agent in about 10 to 25 mg per $m^2$ of the garment or about 0.1 to 10% by weight of the garment. When a scrim is not present, then the interior side of the garment is coated.

Any conductive water absorbing inorganic salt or its hydrates may be utilized provided it is not irritating to the wearer. The salts include sodium sulfate and its hydrates, calcium sulfate and its hydrates, calcium acetate and its hydrates, magnesium sulfate or acetate and its hydrates, magnesium chloride, lithium chloride and boric acid. When the scrim is attached to the film, conductive particles, and/or conductive and water absorbing salts may be utilized to form the electrically conductive layer.

In the case of the scrim, any conventional non-woven web can be used which can be melt blown or spin woven provided it is breathable and allows moisture to pass which comes from the humidity within the garment generated by the wearer. The scrim and film layer can comprise any of the conventional materials such as polyolefin, for example, polyethylene and polypropylene, polyvinyl alcohol, polyethylene terphthalate, nylon, KEVLAR®m polyacrylates, polymethacrylates, ionomers, and the like.

The conductive and water absorbing or hygroscopic compounds can be used alone or in combination with other conductive materials such as carbon black, metal particles, sodium alkylsulfonates or any conventional anionic, nonionic, cationic, and amphoteric antistatic agents.

In some applications, slip additives or waxes may be used to reduce the friction coefficient which exercise some slight antistatic action. Representative of such substances are stearyl alcohol and stearyl amine. These are generally applied externally and are flammable.

The antistatic components may be applied with aqueous or non-aqueous solutions and drying, dusting while extruding or spun bonding and similar application as to external application of antistatic compounds. These antistatic agents also enhance fire resistance of the garment.

The following table shows the correlation between surface resistivity and half-life period in plastics

| Surface Resistivity (Ω) (DIN 53482) | Half-life Period τ (s) (Honestometer) | Antistatic action |
|---|---|---|
| $<10^9$ | 0 (no charge) | Excellent |
| $10^9$ to $10^{10}$ | 1 | Very good |
| $10^{10}$ to $10^{11}$ | 2 to 10 | Good to satisfactory |
| $10^{11}$ to $10^{12}$ | 10 to 60 | Moderate |
| $>10^{12}$ | >60 | Insufficient |

The table indicates that plastics with a surface resistivity of $10^9\Omega$ are no longer open to static charging. Between $10^9\Omega$ and $10^{12}\Omega$ the surface resistivity can be successfully used to evaluate static charges and charge decay; about $10^{12}\Omega$ it appears to be less suitable for this purpose.

The aforementioned antistatic agents can be used in connection with any chemical and/or biological agent protective garments, for example, as described in U.S. Pat. Nos. 5,690,475, 5,774,891, and 4,433,026, which are herein incorporated by reference.

It is understood that modifications of the invention may be made without departing from the spirit of the invention such as including antistatic compounds to protective garments already having an external antistatic agent or incorporated into the plastic during molding or extrusion.

What is claimed is:

1. In a biological and chemical protective garment having an exterior and interior polymeric film surface, the improvement which comprises that the interior of said garment has coating of an antistatic effective amount of a conductive inorganic salt selected from the group consisting of a water-absorbing salt and a hygroscopic salt, said garment comprising about 0.1 to 10% by weight of said garment.

2. The protective garment of claim 1 wherein said garment has the internal portion of an outer film layer coated with said inorganic salt.

3. The protective garment of claim 1 wherein said garment has an interior non-woven scrim containing said inorganic salt.

4. The protective garment of claim 3 wherein said scrim is attached to an outer film layer with a pressure sensitive adhesive containing an antistatic agent so as to form an electrical bridge.

5. The protective garment of claim 3 wherein said scrim is spin bonded or melt spun and a powder of said inorganic salt is applied.

6. The protective garment of claim 3 wherein said scrim comprises about 10 to 25 mg per $m^2$ of said inorganic salts.

7. The protective garment of claim 1 comprising 10 to 25 mg per $m^2$ of the interior film surface of said garment of said salt.

8. The protective garment of claim 1 wherein said inorganic salt is selected from the group consisting of alkali metal salts, alkaline earth metal salts, boric acid, and hydrates thereof.

9. The protective garment of claim 1 wherein said inorganic salt is selected from the group consisting of sodium sulfate, calcium sulfate, calcium acetate, magnesium acetate, magnesium sulfate, magnesium, chloride, lithium chloride and the hydrates thereof.

10. The protective garment of claim 1 wherein said garment comprises a film layer selected from the group consisting of polyolefin, polymethacrylate, ionomer, polyvinyl alcohol and polyethylene terephthalate.

11. A chemical and biologically protective garment comprising:

a) and outer-polymeric film, and b) a non-woven scrim adhesively attached on the interior of said outer film, said scrim comprising an antistatic effective amount of a water absorbing and conductive inorganic salt or hydrates thereof, which antistatic effect is further activated by the humidity within said garment generated by a wearer.

12. The protective garment of claim 11 wherein said scrim comprises a non-woven web having about 0.1 to 25 mg per $m^2$ of said inorganic salt.

13. The protective garment of claim 12 wherein said scrim comprises a polyolefin.

14. The protective garment of claim 11 wherein said scrim is adhesively attached to said outer polymeric film with a pressure sensitive adhesive containing an effective amount of an anti-static agent to form an electrically conductive bridge.

15. A method for providing a protective garment with antistatic properties which comprise including on the internal portion of said garment an antistatic effective amount of a water absorbing and conductive inorganic salt or its hydrate which is further activated by the humidity generated by a wearer to provide an antistatic and fire resistant effect.

16. The method of claim 15 wherein said inorganic salt comprises about 0.1 to 10% by weight of said garment.

17. The method of claim 15 wherein said inorganic salt is incorporated in a scrim of said garment.

18. The method of claim 15 wherein said inorganic salt is selected from the group consisting of alkali metal salts, boric acid and the hydrates thereof.

* * * * *